US005339877A

United States Patent [19]

Marchesan et al.

[11] Patent Number: 5,339,877

[45] Date of Patent: Aug. 23, 1994

[54] CRYSTALLIZER, OR INNER PORTION, OF A MOULD HAVING A LENGTHWISE CURVATURE FOR CONTINUOUS CURVED CASTING OF THIN SLABS

[75] Inventors: Guido Marchesan; Wogler Ruzza, both of Udine, Italy

[73] Assignee: Danieli & C. Officine Meccaniche SpA, Buttrio, Italy

[21] Appl. No.: 968,677

[22] Filed: Oct. 30, 1992

[30] Foreign Application Priority Data

Oct. 31, 1991 [IT] Italy ..... UD91A000181

[51] Int. Cl.[5] ..... B22D 11/00

[52] U.S. Cl. ..... 164/418; 164/459

[58] Field of Search ..... 164/418, 459

[56] References Cited

U.S. PATENT DOCUMENTS

| | | | |
|---|---|---|---|
| 4,635,702 | 1/1987 | Kolakowski | 164/418 |
| 4,716,955 | 1/1988 | Fastert | 164/418 |
| 4,721,151 | 1/1988 | Streubel | 164/418 |
| 4,926,930 | 5/1990 | Gay | 164/418 |
| 4,928,747 | 5/1990 | Pleschiutschnigg | 164/418 |

FOREIGN PATENT DOCUMENTS

| | | |
|---|---|---|
| 0230886 | 1/1987 | European Pat. Off. . |
| 0276418 | 12/1987 | European Pat. Off. . |
| 0300953 | 6/1988 | European Pat. Off. . |
| 3501422 | 1/1985 | Fed. Rep. of Germany . |
| 3528649 | 2/1987 | Fed. Rep. of Germany . |
| 3907351 | 3/1989 | Fed. Rep. of Germany . |
| 1479946 | 5/1966 | France . |
| 58-097466 | 6/1983 | Japan . |

*Primary Examiner*—P. Austin Bradley
*Assistant Examiner*—Rex E. Pelto
*Attorney, Agent, or Firm*—Antonelli, Terry, Stout & Kraus

[57] ABSTRACT

Crystallizer, or inner portion, of a mould having a lengthwise curvature for continuous curved casting of thin slabs (20), the crystallizer comprising an outer, or extrados, plate (12), an inner, or intrados, plate (11) and lateral narrow plates (**13*s*–13*d*) having inner faces (16) defining a casting section (14), the lateral narrow plates (13*s*–13*d*) having their inner faces (16) inclined in such a way as to impart to the downflow channel a tapered conformation which reduces the width of the casting section (14) in the direction of feed of the thin slabs (20), both the extrados (12) and intrados (11) plates being curved lengthwise and containing in their inner upper central portion respective frontal extrados (15) and intrados (115) hollows, the upper part of the inner face (16) of the lateral narrow plates (13*s*–13*d*) comprising a bevel (17) which faces towards the intrados plate (11) and is progressively reduced to zero in the vicinity of the level of the lower end of the extrados (15) and intrados (115**) hollows.

2 Claims, 1 Drawing Sheet

CRYSTALLIZER, OR INNER PORTION, OF A MOULD HAVING A LENGTHWISE CURVATURE FOR CONTINUOUS CURVED CASTING OF THIN SLABS

BACKGROUND OF THE INVENTION

This invention concerns a crystallizer, or inner portion, of a mould having a lengthwise continuous curvature for the continuous curved casting of thin slabs.

The invention concerns, in particular, crystallizers of moulds with upper lenticular enlargements and a continuous lengthwise curvature, the moulds being suitable for the continuous curved casting of thin slabs.

The invention can be applied to moulds having a single lengthwise curvature or a multiple lengthwise curvature.

"Lengthwise" here means in the direction of feed of the solidifying molten metal.

Document US-A-2,564,723 discloses a crystallizer for linear moulds for the continuous casting of thin slabs by making use of lenticular enlargements in the long walls of the mould. This document teaches the symmetrical enlargement of a straight vertical crystallizer and is not suitable for curved crystallizers.

US-A-4,134,441 discloses adjustable lateral narrow sidewalls for use in crystallizers of linear moulds for the casting of slabs. These sidewalls have a tapered development such that they narrow the channel of the steel progressively as that channel is distanced from the meniscus of the liquid metal towards the outlet of the mould.

DE-A-3.528.649 discloses a crystallizer of a linear mould with its upper portion formed as a funnel and with substantially linear sides.

EP-A-0230886 is associated with a vertical straight crystallizer containing a symmetrical enlargement, which has inclined vertical walls with a substantially rectangular development.

DE-A-3.501.422, EP-A-0149724 and DE-A-3.907.351 too disclose a vertical straight crystallizer with a symmetrical enlargement.

EP-A-0300953 discloses a crystallizer which is straight and vertical in its upper portion where the tundish discharge nozzle is inserted, whereas its lower portion is curved. The crystallizer can also include in its upper portion an arcuate segment which may be on one long side or the other, but no geometric parameter of definition is disclosed. It does not in any way provide for the case of a wholly curved crystallizer and envisages a change of direction of the skin of the thin slab being formed. This change of direction takes place where the straight vertical segment is joined to the lower curved segment and creates problems for the skin being formed, with separations, discontinuous surfaces, localized melting and reduction of withdrawal speeds.

With the technology of the state of the art the steel during continuous casting with partly curved moulds of a known type undergoes dynamic effects due to the motion of withdrawal and the shrinkage due to cooling.

EP-A-027 6418 and JP-A-5897466 include lateral elements for closure and determination of the length of the casting chamber; the former document discloses straight vertical crystallizers, whereas the latter discloses curved crystallizers.

No document of the state of the art concerns a wholly curved crystallizer of a curved mould with both its longer walls including an upper lenticular enlargement, such a mould being curved and suitable for the continuous casting of thin slabs.

SUMMARY OF THE INVENTION

The present applicants have designed, tested and embodied this invention so as to overcome the shortcomings of the state of the art and to achieve further advantages.

The use of a crystallizer of a curved mould is important so that the thin slabs can be controlled in an extensive manner before being released. This is the case because, owing to the thicknesses of the thin slab in question, ranging from 25 to 75 min., it is necessary for the thin slab to be contained in the crystallizer for the greatest possible length.

The curved form is also purposely selected to lessen the height of the plant.

The applicants have found surprisingly that the vertical introduction of the discharge nozzle of the tundish into a crystallizer of a curved mould is advantageous to reduce the mass of molten metal when the lenticular enlargements are contained in the outer extrados plate and in the inner intrados plate; but in this case the lenticular hollow in the outer plate is deeper than that in the inner plate.

This has the result that, in the absence of corrections, there are in the same substantially horizontal cross section greater lengths of the outer plate than of the inner plate. This entails greater extrados perimeters than those in the intrados plate.

In such crystallizers the present applicants have found to their surprise that it is very advantageous to compensate the perimeters by inclining the walls of the lateral narrow plates in the segment affected by the lenticular enlargements.

By compensating the lengths bathed by the liquid metal in the outer plate in relation to those of the inner plate the differences in behaviour are eliminated which arise otherwise in the two surfaces during the process of extraction of the slab from the mould.

In fact, if no compensation takes place, the two surfaces (inner and outer) of the slab undergo different actions during their movement of extraction from the mould.

In such a situation the outer curved side of the slab is compressed sideways to a greater extent than the inner curved side and, in the worst case, there might occur compression of the outer curved side and, at the same time, a lateral separation of the inner curved side from the narrow lateral sides. This would lead to the production of two surfaces of the thin slab having different qualities.

According to the invention, in a lengthwise curved mould provided with lenticular surfaces a special conformation is to be applied to the lateral narrow plates of the continuous casting moulds producing high quality thin slabs.

This conformation, which can be applied to the lateral narrow plates of a mould having a lengthwise curvature together with a crystallizer provided with lenticular surfaces on its plates having a greater width, has the purpose of achieving the following effects:

a) equality of length of the portions bathed by liquid metal on the outer and inner curved plates at each of the cross sections which intersect the lenticular surfaces;

b) a suitable lateral taper of the downflow channel of the slab being formed.

The lateral narrow plates according to the invention not only correct the lengths bathed by the liquid metal but also impart a desired taper to the downflow channel. This lateral taper enables the slab to be supported continuously on the surfaces of the mould during cooling and compensates the consequent shrinkage of the slab.

Prevention of detachment of the slab from the mould obviates anomalous heating of the skin, such heating being capable of causing the occurrence of break-out.

BRIEF DESCRIPTION OF THE DRAWINGS

With the help of the attached figures, which are given as a non-restrictive example, let us now see a preferred embodiment of the invention as follows.

DETAILED DESCRIPTION OF THE DRAWINGS

Figure 5:
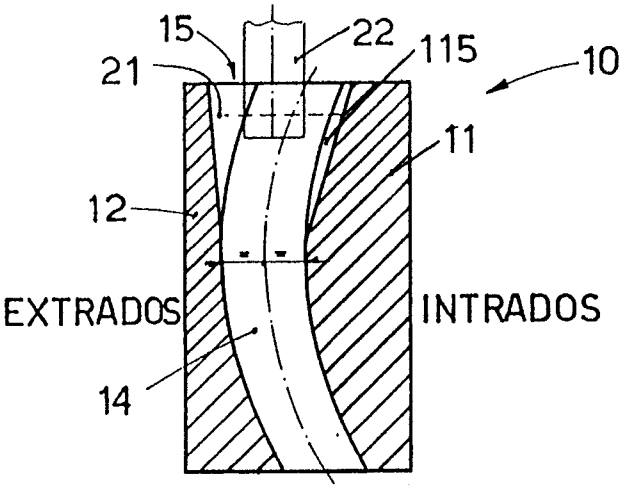
FIG. 5 shows a vertical section of a crystallizer according to the invention.

In the figures a mould 10 to cast thin slabs 20 continuously comprises a crystallizer having a development curved in the lengthwise direction.

This curvature may be formed according to one single radius or be defined by a plurality of radii or by a mixture of curves.

The crystallizer of the mould 10 includes an outer curved, or extrados, plate 12, an inner curved, or intrados, plate 11 and righthand **13*d* and lefthand 13*s* lateral narrow plates 13**.

The lateral plates 13 may be stationary or movable and can have a stationary position or be positioned so as to reduce or increase the transverse length of the long sides of the casting section 14.

The outer curved plate 12 contains in its inner side and in an upper central position in relation to its long side a thumb-nail shaped, or extrados, hollow 15.

The inner curved plate 11 contains in its inner side and in an upper central position in relation to its long side a thumb-nail shaped, or intrados, hollow 115.

The lengths of the arcs DE and HL of the two hollows 15–115 differ substantially from each other and are compensated by the conformation applied to the upper segment of the lateral narrow plates 13.

In substantial correspondence with the lengthwise extent of the hollow 15 in the outer curved plate 12 the lateral narrow plates 13 contain a bevelled portion 17 which faces the inner curved plate 11.

Figure 4:
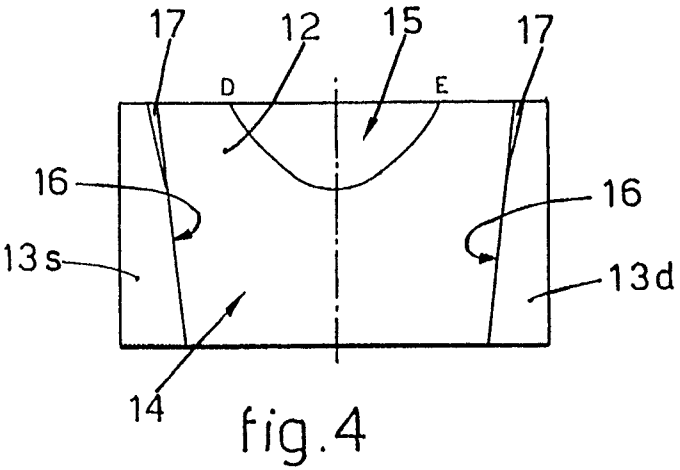
FIG. 4 is a front view of the assembly of FIG. 1 without the inner curved plate.
Figure 1:
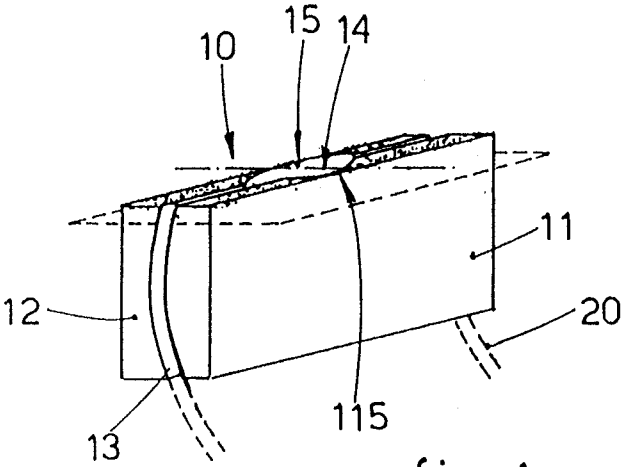
FIG. 1 is a three-dimensional view of a curved lengthwise mould.
Figures 2A, 2B, 2C:
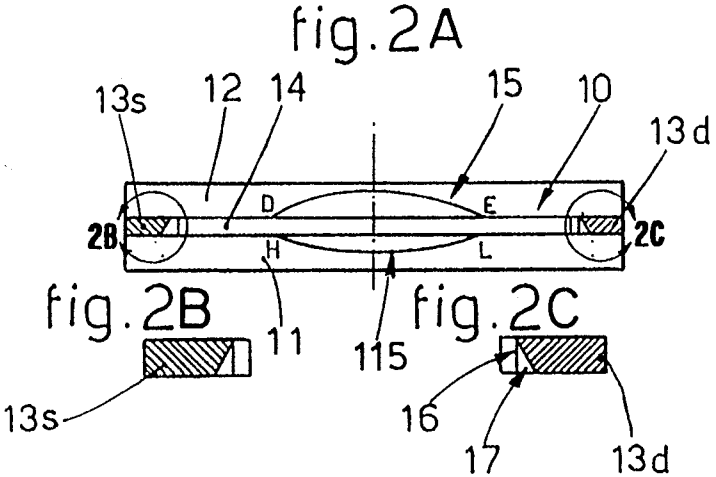
FIG. 2A is a plan view of the mould of FIG. 1.
FIG. 2B and 2C are enlarged views of the end walls in FIG. 2A.

The lateral narrow plates 13 (FIG. 4) not only contain the bevelled portion 17 in their upper segment but are also conformed with an inclined development of their surface 16 within the casting section 14.

The taper thus imparted to the downflow channel of the steel may range from 0% to 2%, depending on the casting parameters (type of steel, speed of extraction, hourly flow of steel, type and characteristics of the cooling, etc.).

Figure 3:
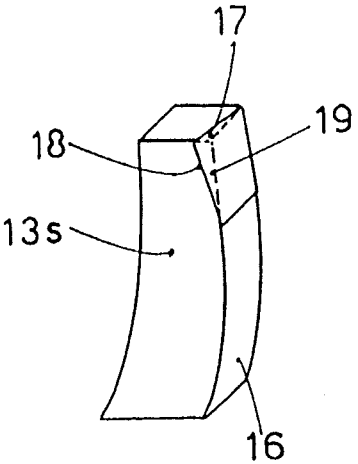
FIG. 3 is a three-dimensional view of a lateral narrow plate according to the invention.

FIG. 3 shows the bevel 17 defined by the continuous line 18 on the lefthand lateral narrow plate **13*s*, and a continuous inclined surface 16 is also shown with a line of dashes 19**.

The bevel 17 has a lengthwise edge which is an extension of the edge of the surface 16 in contact with the outer curved plate 12. This bevel 17 joins the surface 16 at the level of the lower end of the lenticular hollows 15–115.

FIG. 5 shows the crystallizer 10, the level of liquid metal 21 and the tundish discharge nozzle 22.

We claim:

1. A crystallizer of a mold having a lengthwise curvature for continuous curved casting of thin slabs comprising an outer, extrados plate, an inner, intrados plate and lateral narrow plates having inner faces defining a downflow channel having a casting section through which thin slabs are fed, the lateral narrow plates having their inner faces inclined in such a way as to impart to the downflow channel a tapered conformation which reduces the width of the casting section in the direction of feed of the thin slabs, wherein the extrados and intrados plates are curved lengthwise and contain in their inner upper central portion respective frontal extrados and intrados hollows, and wherein an upper part of the inner face of the lateral narrow plates comprises a bevelled surface bevelled with respect to inner faces of said extrados and intrados plates wherein said bevelled surface faces towards the intrados plate and is progressively reduced to zero in the vicinity of the level of the lower end of the extrados and intrados hollows.

2. A crystallizer as claimed in claim 1, in which the lateral taper of the face of the lateral narrow plates ranges from zero to two per cent.

* * * * *